US005331874A

United States Patent [19]

Foster et al.

[11] Patent Number: 5,331,874

[45] Date of Patent: Jul. 26, 1994

[54] CUTTING APPARATUS

[75] Inventors: Clyde E. Foster; George R. Alcorn, both of Pasco, Wash.

[73] Assignee: Universal Frozen Foods, Inc, Twin Falls, Id.

[21] Appl. No.: 118,999

[22] Filed: Sep. 9, 1993

Related U.S. Application Data

[63] Continuation of Ser. No. 979,427, Nov. 19, 1992, abandoned, which is a continuation of Ser. No. 778,300, Oct. 16, 1991, abandoned.

[51] Int. Cl.[5] ..... B26D 3/11

[52] U.S. Cl. ..... 83/423; 83/435.2; 83/932; 198/626.6

[58] Field of Search ..... 83/932, 865, 13, 422, 83/423, 424, 435.2; 198/626.6, 626.5, 626.1, 690.2

[56] References Cited

U.S. PATENT DOCUMENTS

| | | | |
|---|---|---|---|
| 1,937,049 | 11/1933 | Toland et al. | 83/420 X |
| 2,323,092 | 6/1943 | Kerr | 460/53 |
| 2,598,190 | 5/1952 | Offutt | 198/626.6 X |
| 2,787,273 | 4/1957 | Kerr | 460/53 X |
| 2,797,751 | 7/1957 | Schmidt et al. | 83/424 |
| 3,386,564 | 6/1968 | Pease | 198/626.6 |
| 3,718,819 | 2/1973 | Miksitz | 198/626.6 X |
| 4,420,118 | 12/1983 | Gehlen | 83/423 X |
| 4,644,838 | 2/1987 | Samson et al. | 83/865 |
| 4,926,726 | 5/1990 | Julian | 83/165 |
| 4,979,418 | 12/1990 | Covert et al. | 83/865 |
| 5,010,796 | 4/1991 | Mendenhall | 83/865 |
| 5,042,342 | 8/1991 | Julian | 83/98 |
| 5,167,177 | 12/1992 | Cimperman et al. | 83/932 X |
| 5,168,178 | 12/1992 | Cimperman et al. | 83/932 X |

*Primary Examiner*—Richard K. Seidel
*Assistant Examiner*—Kenneth E. Peterson
*Attorney, Agent, or Firm*—Foley & Larnder

[57] ABSTRACT

The present invention relates generally to a cutting system for vegetables, including potatoes, which includes a conveyor for transporting food product to the general vicinity of a rotating cutting blade. The conveyor generally aligns the food product and arranges it in a single row. The conveyor introduces the food product between a pair of endless belts which include contoured paddles on their mating surfaces to receive the food product and drive it toward the cutting knife. The endless belts are floating and coupled to pneumatic pistons to maintain contact between the paddles and the food product, even though the food product may vary in size. A double sided driving chain belt drives the endless belts to ensure positive, non-slipping feeding. The paddles prevent rotation of the food product while it is being cut. In the most preferred embodiment, the device is used for feeding potatoes into a rotating knife adapted to cut helical strips.

12 Claims, 1 Drawing Sheet

CUTTING APPARATUS

This is a continuation of application Ser. No. 07/979,427 filed Nov. 19, 1992, now abandoned, which is a continuation of application Ser. No. 07/778,300 filed Oct. 16, 1991, now abandoned.

BACKGROUND OF THE INVENTION

1. Field of the Invention

The present invention relates generally to the art of cutting food products, and more specifically to a device for cutting vegetables, such as potatoes, into desired shapes. Still more specifically, the present invention, in its most preferred form, relates to a system for cutting helical strips of potatoes and includes a pair of endless belts carrying contoured paddles for aligning and feeding potatoes through a rotating cutting mechanism.

2. Description of the Prior Art

Many devices have been described in the prior art for cutting and slicing vegetables, including potatoes. Many of the devices described in the patent literature are designed for use at home or for the handling of individual food products. Simple examples of such systems would be found in most households, e.g. rotary food processors, vegetable slicers, etc.

The commercial cutting of potatoes into variously shaped pieces has also been known for a number of years. Frozen potatoes can be purchased in grocery stores in a variety of shapes, including the common shoe string shape (generally square in cross-section and having a length of 3–4 inches or longer), crinkle-cut (which have a corrugated appearance), and in recent years, helical strips of potatoes which are of the type sold by the assignee of the present invention under the trademark CURLEY Q®. Many other shapes of potatoes are available in restaurants, and the variety of shapes has risen dramatically in recent years. Potatoes are now manufactured for distribution with skin on or with skin off and are prepared for reconstitution by deep frying, baking, microwave heating, etc.

The evolution of the helical potato is a phenomenon of the middle to late 80's. Somewhat similarly shaped products were known prior to that time and were prepared using hand crank machines such as those encountered at county fairs and in small restaurants. The early cutters for making helical strips typically had a system for impaling the potato on a rotating, screw driven holder and for rotating it into a fixed knife to produce helical strips. The product was typically uneven in appearance, and the process was also slow. Moreover, the process typically resulted in inefficient use of the potato, as the butt ends of the potato were not included in the final product and were discarded or were used for other purposes.

It was not until the assignee of the present invention introduced the CURLEY Q® potatoes in 1983 that the cut variety became popular on a national basis, especially in institutional food outlets such as fast food restaurants, hotels, schools and the like. The reason for the increase in popularity was the improved product quality and appearance and the ability to commercially manufacture the product using the cutting device described in U.S. Pat. No. 4,644,838, issued Feb. 24, 1987 to Sampson, et al. and entitled "Apparatus For Helical Cutting Of Potatoes". In the device shown in this patent, various conveyors bring potatoes to a plurality of tubes. A potato is deposited in each tube and held therein against rotation by a plurality of spring loaded, generally triangularly shaped fingers. A knife, which includes a number of upstanding scoring blades, and a radially extending slicing blade is located beneath the tube and is designed to be rotated during the cutting operation. The patent further describes a plunger system for exerting downwardly extending forces on the potato held in the tube to push the potato through the slicing knife, resulting in a plurality of helical strips of varying diameter, depending on the distance from the axis of the tube.

In the preferred embodiment of the Sampson, et al. patent, the bottom of the plunger includes recesses to receive the upstanding scoring blades, so that the entire potato can be cut using the process. This feature eliminates prior difficulties with the waste resulting from butt ends. The knife itself is rotated by a motor and a belt, and a stationary tube located on the downstream side of the knife receives the product. After being cut, separation of the various coils takes place to improve product appearance. Initially, such separation was accomplished by hand. Later developments have lead to mechanical coil separators for this part of the process. Following cutting, downstream processing includes par-frying, freezing and packaging. The CURLEY Q® fries have also been coated with batter and flavor ingredients to result in a family of products having different taste and appearance characteristics.

Since the introduction of this product by the assignee of the present invention, numerous other frozen potato manufacturers have introduced similarly shaped products, some using different cutting technologies. Moreover, the assignee of the present invention has itself developed improvements, such as a "cutting assembly" described in U.S. patent application Ser. No. 07/682,653, filed in the name of Foster on Apr. 9, 1991. In this application, a tiered blade is used instead of the blade described in the Sampson, et al. patent. The blade is positioned to form concentric longitudinal cuts in the potato, such that helical strips are produced in an efficient and reproducible manner.

Other patents have issued to competitors of the assignee on cutting knives and on production devices, such as the systems described in U.S. Pat. No. 4,926,726, issued May 22, 1990 to Julian and entitled "Food Processing Apparatus" and U.S. Pat. No. 4,979,418, issued Dec. 25, 1990 to Covert, et al. and entitled "Food Processing Apparatus". In both patents, a rotating cutting knife is used to produce helical strips from potatoes forced through the knife using an elongate feed system including conveyors and spring biased paddle and spike members. The feed device is described as being very similar to the SC-120 Corn Cutter marketed by FMC Corporation to feed corn cob to a cutting assembly, which machine is described in detail in U.S. Pat. No. 2,787,273. The feed conveyor includes U-shaped areas on metal plates for centering the potato, dogs to maintain product alignment and a spring loaded plate floating on top of the potatoes as they pass along the line. As the potatoes enter the area adjacent the rotating cutting knife, they pass through a series of parallel shafts extending across the path of travel, the first two shaft pairs including a plurality of paddles which urge the potatoes forwardly toward the knife, and the last pair of shafts including a plurality of spikes which grasp and penetrate the potato as it is being pushed through the cutting knife. Each pair of shafts, one above and one below the feed path, is spring biased to compensate for different sized products. The device can operate continuously, with one potato following another through the system.

Another potato cutting system is described in U.S. Pat. No. 5,010,796 issued Apr. 30, 1991 to Mendenhall for "Helical Split Ring French Fry And Method For Making The Same" and concerns the preparation of helical, split-ring food products. Mendenhall employs the same general type of cutting knife used in the Samson et al. patent system, but the potato product is slotted before it reaches the knife so that, instead of coils, rings are produced. The conveyor system in Mendenhall includes a V-shaped lower portion, which is open at its bottom to permit the slotting blade to cut the potatoes, and spring biased rollers on the top to urge the potatoes toward the cutting knife. In one embodiment, the rollers are replaced by a belt which is generally planar and which is urged into contact with the potatoes by a plurality of spring biased rollers.

Water gun systems have also been known for some time in the potato processing field, i.e. systems which use a tube to align potatoes and water pressure to push the potatoes through the tube at increasing velocity and through knives of various types. Typically, such devices have been used for making straight cut potatoes, wherein fixed, crossed blades are mounted at the outlet of the water gun, and the potatoes are merely forced therethrough at high speeds.

One attempted use of a water-feed system for the preparation of helical cut french fries is described in U.S. Pat. No. 5,042,342, issued Aug. 27, 1991 to Julian for "Food Processing Apparatus". An embodiment disclosed in this application shows a tubular, elastic, tapered feed tube for feeding potatoes under the force of water pressure through a rotating cutting knife to form helical potato strips. According to the application, the elastomeric member expands once the potato reaches the tapered end, thus decreasing the velocity of the potato, but increasing the water pressure to the range of 15–25 psi. The applicant indicates that the potato is forced evenly and gently onto a central alignment tube of the knife and that the alignment tube further serves to decelerate the potato before the slicing blades cut the potato into helical strips. The specification also indicates that no external mechanical devices touch the potato, thus eliminating any damage to the outside of the potato.

While various systems have been proposed, it would represent a significant advance in this art to provide a feed system in which potatoes would be forced through a cutting head to form cut product at a consistent velocity and on a continuous basis, without the need to raise and lower a plunger between each product cutting step. It would also be desirable for some cut configurations and in some manufacturing environments to use a mechanical feed system, as opposed to water-feed systems. While it is desirable to minimize damage to the exterior of the potato, exterior damage is more likely to occur in the feed systems described in the Julian and Covert, et al. patents due to the nature of the paddles and the spikes used to drive the potato through the cutting knife. A system which mechanically drives potatoes, one following the other, into a cutting knife to produce high quality product, at increased speeds and with minimal mechanical forces being exerted on the skin of the potato would represent a very substantial advance in this art.

SUMMARY OF THE INVENTION

The present invention provides advantages not heretofore described in the prior art known to applicants, including the principal advantage of continuously feeding food product, especially potatoes, to a rotating cutter knife at an increased velocity and without damage to the potato. Another advantage of the present invention is the ability to precisely align and feed product into the rotating cutting assembly, with the product following in a continuous line without the need for an intermediate plunger withdrawal and loading step as was required in the aforementioned Sampson, et al. system.

A further advantage of the invention resides in the ability to conduct such feeding operation without the use of the types of paddles and spike members referred to in the aforementioned Julian and Covert, et al. patents.

A still further advantage of the invention is the utilization of pneumatic pressure cylinders to accommodate product of varying sizes.

Another advantage of the present invention is the ability to use the feed system with a variety of cutting assemblies, whereby different configurations of final cut product can be made, including the cutting assembly described in the aforementioned Sampson, et al. patent and the tiered blade described in the above-referenced pending application of Foster.

How these and other advantages of the invention are accomplished will be described in the following detailed description of the preferred embodiment, taken in conjunction with the FIGURES. Generally, however, the advantages are accomplished by providing a conveyor system for transporting product from a storage and preparation area to the vicinity of the cutting apparatus. Product is deposited into a vibrating feed hopper which deposits product in a longitudinally aligned and end-to-end relationship in a single row on a conveyor belt. From the belt, product is conveyed between two endless belts which carry a plurality of contoured paddles and which are driven by a double sided timing chain to transport product from the conveyor to the knife. The paddles are contoured, to define a generally cylindrical flow path for the product as it approaches the knife. Product of different size is accommodated and kept in contact with the belts by means of a plurality of pneumatic cylinders acting on each belt. The product is initially contacted by the center tube of the cutting apparatus, in the most preferred embodiment, a tiered blade, and passes through the knife for subsequent processing.

Further ways in which the advantages described above are accomplished in the present invention will become readily apparent to one skilled in the art after the present specification has been read and understood. Such other ways are deemed to fall within the scope of the present invention, especially if they fall within the scope of the claims which follow.

DESCRIPTION OF THE DRAWINGS

In the various drawings, like reference numerals are used to denote like components.

DETAILED DESCRIPTION OF THE PREFERRED EMBODIMENT

Figures 1, 2:
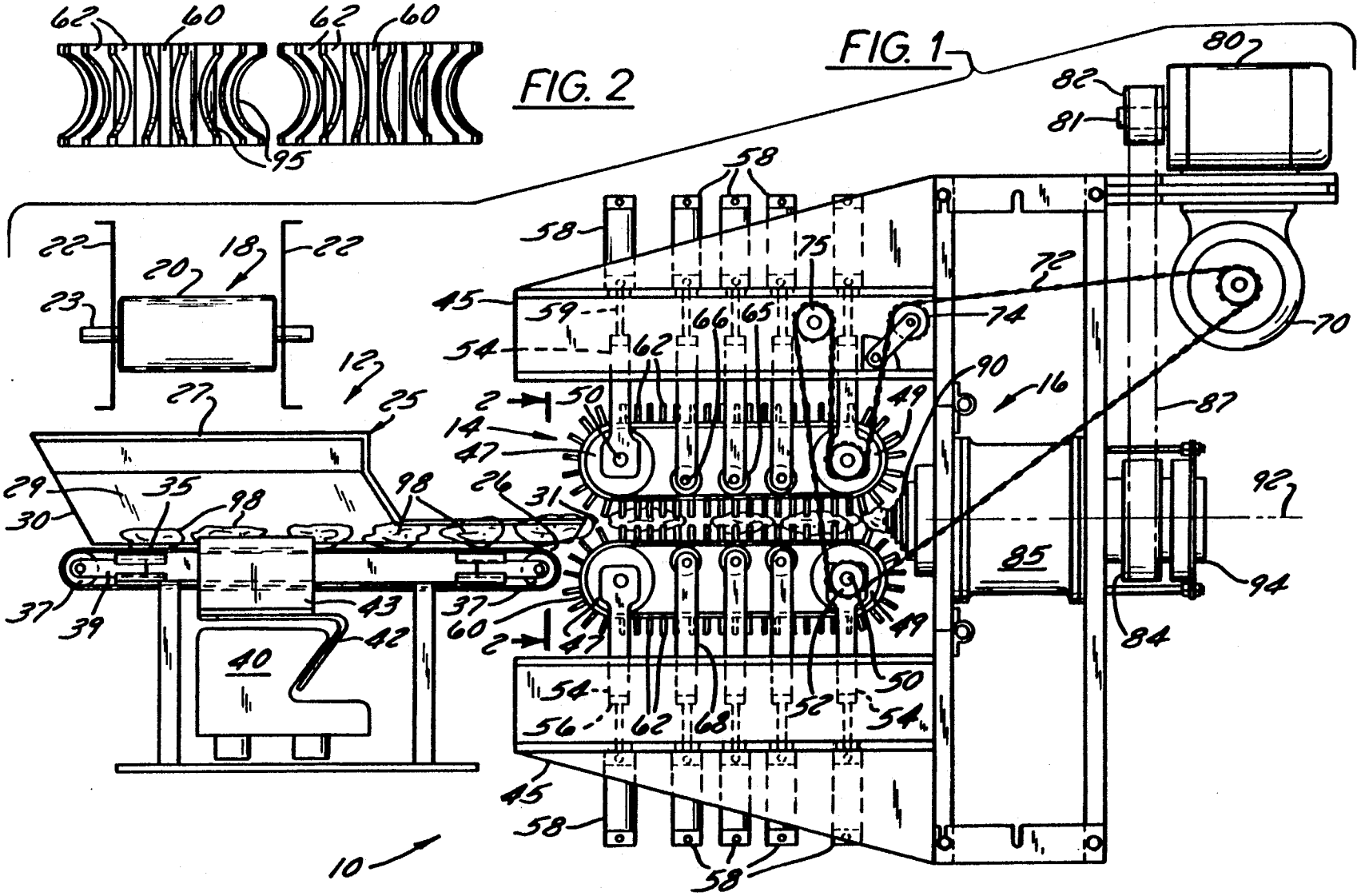
FIG. 1 is a schematic view of the mechanical cutting apparatus of the preferred form of the present invention.
FIG. 2 is a schematic end view taken along the line 2—2 of FIG. 1 illustrating the contour of the endless belt components of the preferred embodiment of the present invention.

Before proceeding to the description of the FIGURES, several general comments need to be made about the applicability of the present invention and the components thereof which form the main features of it. First, while the device is described in connection with the cutting of potatoes, the device could be used for cutting other food products. Moreover, while a rotating cutting knife is described, i.e., the one which is the subject matter of the aforementioned Foster application, other rotating cutting knives could be employed, such as the Samson et al. knife, and stationary knives could also be used for different cut configurations.

Certain components shown in FIG. 1 are for illustration purposes only and, in and of themselves, do not form part of the present invention. For example, conveyors are shown in rather schematic form and could be replaced by numerous other conveyor types known to the food handling art. Finally, the upstream and downstream processing devices are not shown or described. Generally upstream of the device shown in FIG. 1, devices are provided for removing food products from storage and, in the case of helical cut fries, for cleaning and preheating the potatoes (ideally to a core temperature of about 130° F.) to improve the cutting operation. Downstream of the assembly shown in FIG. 1 are devices for receiving the cut product, separating coils and loops if the device is used for making helical fries, parfrying, freezing, and packaging. Furthermore, in the case of coated fries, batter coating stations would be provided downstream of the cutting assembly.

Proceeding now to a description of FIG. 1, the cutting apparatus 10 according to the preferred form of the present invention is shown to include three general sections: a conveyor and alignment section 12, a feed section 14, and a cutting section 16. Each will be described in sequence, it being understood that certain frame and support elements have been eliminated for ease of explanation of the present invention.

The conveyor and alignment section 12 includes two major components. An input conveyor 18 is shown at right angles to the flow of product through cutting apparatus 10 and includes a conveyor web 20, mounted in a framework 22 on rollers (not shown) having shafts 23 and being adapted for delivering washed and graded products, in this case potatoes, to cutting apparatus 10. The drive components for the conveyor are not illustrated as, in and of themselves, input conveyors are well known in this art.

The input conveyor 18 is arranged to deposit potatoes into a receiving hopper 25 which has an open top 27 and a generally rectangular horizontal cross-section. The lower portion 29 of hopper 25 is tapered inwardly along its front and back walls and is open at the bottom to form an elongated slot 26 extending along the bottom of hopper 25 from its left end 30 to its right end 31. The width of the slot is selected to be larger than the largest potato to be processed in cutting apparatus 10 but to be small enough to allow only single potatoes to pass therethrough. Moreover, since it is desired to have each potato be longitudinally aligned with the slot (most potatoes used for french fry operations having a longer axis and a shorter dimension), the slot should desirably be narrower than the long dimension of the potatoes. While, of course, each potato will be different, typically the potatoes are graded for size using screening devices upstream of the input conveyor 18.

The slot 26 is located a small distance above a second input conveyor 35 mounted and adapted to move potatoes in a direction generally from end 30 to end 31 of the hopper 25. Again, for ease of explanation, the drive components for this conveyor have not been shown, although the rollers 37 for mounting the web and their supporting brackets 39 are shown. Finally, the input and alignment section 12 includes a vibrator 40 coupled by arms 42 to a pair of plates 43, affixed to the front and back sides of hopper 25. Gentle vibration of the hopper 25 assists in alignment of the potatoes, with the bottom edges thereof resting on web 35 for movement along the slot 26 toward the feed section 14, now to be described.

Feed section 14 includes a framework 45 located in the vicinity of the output end 31 of hopper 25. Framework 45 serves to support a pair of upper and lower idler rolls 47 and a pair of drive rolls 49, the sets of rolls being spaced apart by a desired dimension, e.g., two feet or more. Each of the rolls includes a shaft 50 running therethrough, and a drive sprocket 52 is mounted on one end of shaft 50 for each of the drive rolls 49. The shafts 50 are each journalled between a pair of belt supports 54 which, for each roller, are joined by a cross member 56 to form a generally U-shaped support assembly.

In the illustrated embodiment, each of the rollers is biased toward the center of feed section 14 by one of a plurality of pneumatic cylinders 58, each of which includes a piston rod 59 joined to a cross member 56. The air supply for the cylinders 58, as well as the associated hose and valving components, are not shown but would be readily appreciated by one skilled in the art after the present specification has been read in its entirety.

Mounted on each set of idler rolls 47 and drive rolls 49 is an endless belt 60 which, in the preferred embodiment, will be approximately 3–8 inches wide, or wider, and which carries a plurality of paddle elements 62 extending perpendicularly therefrom. The paddles will be several inches in height and will be described in greater detail in connection with FIG. 2. When assembled, however, the paddles 62 of one belt will be spaced apart just slightly from the opposing paddles of the other belt.

It can also be appreciated by reference to FIG. 1 that several biasing rolls 65 are provided for the upper and lower belts 60, each of the biasing rolls 65 including a shaft 66 extending outwardly from the side edges of the belts 60 and journalled for rotation in supports 68. These supports are also coupled to pneumatic cylinders 58 as were the idler and drive rolls previously described.

The overall arrangement of the feed section 14 with respect to the input and alignment section 12 is such that the average axis of potatoes moving along web 35 will be approximately at the midpoint between the paddle elements 62 and at the horizontal midpoint of the paddle elements 62 as well. The term "average axis" is used here to mean the hypothetical axis which would exist if each of the potatoes were of an identical diameter which, of course, can never occur. However, it will now be appreciated that as potatoes move through the feed section 14, they will be maintained generally aligned with the average axis by the paddles due to the floating nature of the drive and idler rolls 49 and 47 and the biasing rolls 65 described heretofore. This will be the case regardless of the size of the potatoes, since each of the ten rolls depicted in FIG. 1 (the number could be substantially greater or could be less) acts independently of the others to accommodate the variations which occur from potato to potato.

The two belts 60 are driven at identical speeds by motor 70 and drive chain belt 72. The drive chain belt 72 is preferably double sided and is arranged to drive both sprockets 52 to ensure that potatoes being moved by the belts 60 do not experience frictional degradation by the paddle elements 62. To this end, a takeup sprocket 74 is provided on the frame assembly, along with an idler sprocket 75, all arranged to maintain the desired tension and driving contact of drive chain belt 72 about the two sprockets 52.

Proceeding now to a brief description of the cutting section 16, numerous details have been eliminated here because such details are, in and of themselves, not part of the present invention and because the drive systems are described in detail in the aforementioned Samson et al. patent and the Foster application. Generally, however, the cutting section includes a motor 80 having a shaft 81, the latter having a pulley 82 mounted thereon. Pulley 82 is coupled to another pulley 84 on the rotary knife assembly 85 by a belt 87 shown in phantom in the illustration. The knife 90 is of the type shown in the Foster application and it will be appreciated to those familiar with the helical fry cutting art that when motor 80 is activated, the knife 90 will rotate about an axis 92 shown in dotted line to act upon potatoes contacting the knife to form helical strips of varying diameter, depending upon the distance from the axis. The helical strips will be received in a stationary tube 94 and will be moved downstream to the post cutting processing equipment described briefly above.

Before proceeding to a description of the operation of the preferred embodiment, reference should now be had to FIG. 2, which is an end view of the two belts 60 and showing the contour 95 of the paddle elements 62. For use with potatoes, the contour 95 is generally semi-circular so that a generally circular profile is maintained between the paddles 62 as they pass between the idler rolls 47 and the drive rolls 49. Due to the floating nature of the supports for belt 60, the diameter of the circular profile may change depending upon the size of the potatoes passing therethrough, and can vary independently along the length of this path.

The belts 60 must, obviously, be made of flexible material, but the actual material of construction can be selected from a number of rubber, resin, or cloth materials. Similarly, a variety of materials can be used for paddle elements 62, synthetic resins being preferred. To minimize damage to potatoes flowing through feed section 14, it is desirable to have some degree of resiliency between the paddle elements and, to avoid damage to the exterior of the potato, relatively soft but durable synthetic resins are preferred. At the present time, we believe that polyurethane is a suitable material for paddle elements 62. It should also be understood that the paddle elements 62 and belts 60 can be integrally formed (e.g. molded), and that instead of the paddle elements 62 a contoured thicker belt could be employed.

Proceeding now to a description of the operation of cutting assembly 10, product to be cut is brought to the knife initially on web 20 and deposited into hopper 25. In the hopper, the potatoes will tend to pile up but will be aligned at the bottom due to the tapered walls 29 and the slot at the bottom of the hopper (see the phantom potatoes 98 in dotted line). Vibrations generated by vibrator 40 will assist in such alignment. The potatoes will come to rest on web 35 and be moved toward the feed section 14, maintaining an average axis which is generally coincidental with the axis 92. Potatoes will be firmly grasped by the paddles 62 as they enter the feed section and will be driven therethrough by motor 70, differences in potato diameter being accommodated by the floating action of the various rolls acting upon belts 60. Potatoes will flow in an end-to-end relationship along the profiled pathway toward the cutting knife 90, where they will be fed to and through knife 90. Throughout this time, in addition to forward movement, the biasing rolls will prevent rotation of the potatoes as they reach and pass through knife 90. The knife itself will be driven by motor 80 about an axis 92 to form helical strips, as is known for this particular knife configuration.

While dimensions and materials of construction can vary widely, the principal advantage of the present design over prior devices is the continual feeding of product to be cut through a rotating knife using members which are contoured for the particular product and which do not penetrate or otherwise damage the skin of the product. Axial alignment of the product with the center tube of the knife is ensured by the positive contact between the product and the profile 95 of paddle elements 62, leading to improved recovery and product appearance. Moreover, since there is no need for any type of plunger removal and loading step, as was the case with the Samson et al. system, machine speeds can be dramatically improved when compared to that system.

While the present invention has been described in detail in connection with a single illustrated embodiment, it is not to be limited thereby but is to be limited solely by the claims which follow.

We claim:

1. A cutting apparatus for food items comprising a knife for cutting the food items into a desired configuration and means for feeding the food items to the knife and for urging the food items therethrough, the feed means including:

an upper endless belt made from a flexible material and mounted about an upper idler roll and an upper drive roll, the upper idler roll and upper drive roll being spaced from each other;

a lower endless belt made from a flexible material and mounted about a lower idler roll and a lower drive roll, the lower idler roll and lower drive roll being spaced from each other, wherein the upper and lower endless belts each extend into proximity with the knife and are spaced from each other to generally define a flow path for the food items;

means for providing the belts with a contour having a profile generally matching that of the food items to be cut as food items are passed between the belts, the endless belts each comprising an elongate generally planar belt and the providing means comprising a plurality of contoured resilient paddles carried by the endless belts, the paddles defining the contour having a profile generally matching that of the food items to be cut; and means for driving the upper and lower drive rolls.

2. The cutting apparatus of claim 1, further including a conveyor for transporting food items to the feed means.

3. The cutting apparatus of claim 2, wherein the conveyor comprises means for aligning the food items in a generally end-to-end relationship and includes a moving conveyor belt having a hopper mounted thereover, the hopper having an elongate open bottom slot through which the food items contact the conveyor belt.

4. The cutting apparatus of claim 3, including a vibrator for shaking the hopper to assist in the alignment of food items on the conveyor belt.

5. The cutting apparatus of claim 1, wherein the upper and lower endless belts are biased toward one another generally along their length.

6. The cutting apparatus of claim 5, wherein a plurality of rolls are mounted within each of the endless belts, the rolls being biased toward the rolls of the other belt by means for exerting a biasing pressure thereon.

7. The cutting apparatus of claim 6, wherein the exerting means comprise pneumatic cylinders.

8. The cutting apparatus of claim 1, wherein the food items are potatoes and the cutting knife is a rotary cutting knife adapted to cut helical strips.

9. The cutting apparatus of claim 1, wherein the contour is a generally semi-circular contour.

10. The cutting apparatus of claim 1, wherein the knife is a rotating cutting knife.

11. The cutting apparatus of claim 1, wherein each of the endless belts is driven at the same speed as the other belt.

12. The cutting apparatus of claim 11, wherein the belts each have a drive roller including a drive sprocket and a single drive chain couples both sprockets to the means for driving the belts.

* * * * *